United States Patent [19]

Richert et al.

[11] 4,336,956

[45] Jun. 29, 1982

[54] SAFETY TOE UNIT FOR A SKI BINDING

[75] Inventors: Manfred Richert, Farchant; Ralf Storandt, Leonberg, both of Fed. Rep. of Germany

[73] Assignee: Vereinigte Baubeschlagfabriken Gretsch & Co. GmbH, Leonberg, Fed. Rep. of Germany

[21] Appl. No.: 112,813

[22] Filed: Jan. 17, 1980

[30] Foreign Application Priority Data

Feb. 15, 1979 [DE] Fed. Rep. of Germany ..... 2905837

[51] Int. Cl.[3] ..... A63C 9/08

[52] U.S. Cl. ..... 280/625; 280/629

[58] Field of Search ..... 280/611, 623, 625, 626, 280/629, 630, 633, 634, 636

[56] References Cited

U.S. PATENT DOCUMENTS 4,095,821 6/1978 Salomon ..... 280/630 X

FOREIGN PATENT DOCUMENTS 754109 4/1953 Fed. Rep. of Germany .

2030749 6/1970 Fed. Rep. of Germany .

7044757 12/1970 Fed. Rep. of Germany .

*Primary Examiner*—Robert R. Song

*Assistant Examiner*—Michael Mar

[57] ABSTRACT

A safety toe unit for ski binding includes a compensation mechanism to compensate the release setting of the binding for the changes in the frictional resistance to sliding of the ski boot relative to the ski which accompany the continuously changing pressure between the ball region of a skier's foot and the ski. The invention is applicable to most known kinds of safety toe unit and in particular to those safety toe units which feature a safety release mechanism including at least one spring adapted to bias one or more toe clamping elements into a ski boot securing position and operative on the occurrence of a predetermined sideways force to permit sideways pivoting of the toe clamp or at least of an element thereof to a position in which the ski boot is released from the binding. The compensation mechanism features a force signalling device, responsive to the pressure prevailing at the ball region of the ski boot, and which exerts, via a force transmission device, an auxiliary force on the movable end of the bias spring so that the sideways force required at the toe clamp to overcome the bias of the spring is reduced. The mechanical advantage of the force transmission device is chosen so that the maximum possible auxiliary force cannot exceed approximately 40% of the installed spring bias of the release spring.

29 Claims, 20 Drawing Figures

SAFETY TOE UNIT FOR A SKI BINDING

Figure 1:
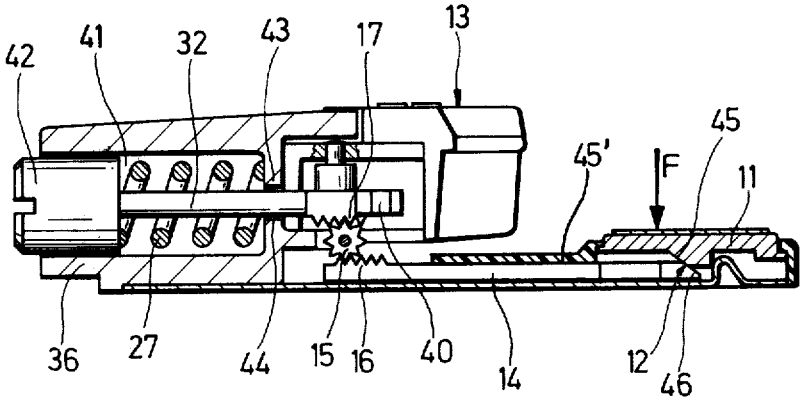

The present invention relates to a safety toe unit for a ski binding and has particular reference to a safety toe unit of the kind in which the sideways release characteristic is influenced by the pressure exerted on the ski by the ball part of the skier's foot via the corresponding 'ball region' of a ski boot.

Safety toe units generally feature a safety release mechanism which includes one or more springs adapted to bias a toe clamp, which may itself be formed in one or more parts, into a position in which it secures the toe portion of a ski boot in position on a ski. The safety release mechanism is intended to operate on the occurence of excessive sideways forces at the toe of the ski boot to permit at least a part of the toe clamp to pivot sideways to a position in which the ski boot is released from the binding.

For reasons which will be later described in more detail it can be desirable to change the release setting of the safety toe unit in response to the pressure exerted by the ball region of the ski boot on the ski. The particular arrangements that have hitherto been proposed are, however, all associated with certain disadvantages. E.g. in the arrangement known from DE-OS No. 2,030,749, which is also assigned to the assignees in respect of the present invention, an auxiliary force derived from the pressure exerted by the ball region of the ski boot on the ski is used to change the engagement angle and thus the latching force between a latch member and the cooperating latch recess. In the specific arrangements shown in DE-OS No. 2,030,749 the auxiliary force is used to displace the profiled latch recess and is generated by depression of a plate located beneath the ball region of the ski boot. This plate must be continuously reset in dependence on the varying pressure by means of auxiliary springs. The precision which is achievable by the displacement of the profiled latch recess is not sufficient to satisfy the present day requirements for a safety binding. A further disadvantage of the known toe unit is that the mechanism providing the auxiliary force is continuously moved as a consequence of the continuously changing pressure on the ball region of the ski boot. This leads to a large degree of wear at the latch and latch recess because of the continuous relative movement of these parts that takes place during skiing. A further disadvantage is the need to correctly adjust the setting of the release mechanism and the resetting springs of the auxiliary force generating mechanism in order to achieve the correct reduction of the release setting.

Another embodiment of this prior art safety toe unit requires two springs arranged one behind the other of which only one is required for the release mechanism. Not only does this increase the constructional complications but problems also exist with the adjustment of the release setting and also with matching the springs one to the other. In order to achieve the correct percentage reduction of the release setting it is necessary to achieve various relief paths for various spring forces. The resulting complicated adjustment matching of the springs one to another must be regarded, alongside the constructional complications and the space requirements, as a further disadvantage.

A further type of safety toe unit is known from DE-GBM No. 70 44 757 which allows compensation for the pressure at the ball region of the ski boot through change of the latching force. In this arrangement the latching force is generated by two springs arranged one behind the other. The pressure prevailing at the ball region of the ski boot is applied to one end of a horizontally and transversely pivoted lever and a push rod at the other end of this lever produces compression of one of the springs so that the other spring is extended and the latching force is correspondingly reduced. This known arrangement, however, requires two springs arranged one behind the other and must be especially constructed to achieve the desired relief effect. Furthermore, the length of the springs results in an undesirably long toe unit and it is difficult to achieve the desired degree of stability of the operating lever.

Finally, it is also already known from DE-PS No. 7 54 109 to influence a safety device for ski bindings so that the resistance of the device against opening and release of the binding is changed in the sense that on upward pivoting of the foot from the ski the resistance to release of the binding decreases. This known arrangement thus requires the foot to be lifted from the ski in order to effect this control and such lifting is not acceptable for present day downhill safety ski bindings.

The principal object underlying the present invention is to provide a safety toe unit of the kind in which a compensation mechanism compensates the release setting for the pressure prevailing at the ball region of the ski boot, which securely positions the shoe within the binding until safety release occurs and which, apart from unavoidable elastic deformations, does not involve movement of the compensation mechanism, which could give rise to increased wear, until the start of safety release.

For accomplishing this task the present invention envisages a safety toe unit for a ski binding having a safety release mechansim including spring means adapted to bias toe clamp means into a ski boot securing position and operative on the occurrence of a predetermined sideways force to permit sideways pivoting of at least a part of the toe clamp means to a ski boot releasing position, a force signalling device adapted to be arranged at a position corresponding to the position adopted in operation by the ball region of the sole of the ski boot said force signalling device being responsive to pressure exerted from above to generate, via a force transmission device, an auxiliary force on the safety release mechanism to reduce the bias of said spring means on said toe clamp means to assist the release thereof, the arrangement featuring means for applying said auxiliary force to said spring means via end means thereof which end means are directly movable during sideways pivoting of said at least one part of the toe clamp means and wherein the mechanical advantage produced by said force signalling and transmitting devices is such that the magnitude of said auxiliary force is always smaller than the spring bias which determines the release setting of the binding for any load exertable by a skier through the ball region of the ski boot on said force signalling device.

Thus the present invention is generally applicable to a safety toe unit in which the safety release mechanism includes one or more springs which are collectively referred to as spring means. Furthermore, the invention is also generally applicable to safety toe units irrespective of the nature of the toe clamp which is used to secure the ski boot to the ski. Toe units commonly feature either a single toe clamp adapted to embrace the forward toe portion of the sole of the ski boot or two toe clamp parts arranged one to either side of the central longitudinal axis of the binding. The various possible types of toe clamp construction are conveniently referred to as toe clamp means. It is a feature of practically all known safety toe units that sideways pivoting movement of at least a part of the toe clamp means will be accompanied by corresponding movement of the end part, or end parts, of one or more associated springs. Such end or end parts are conveniently referred to as end means and may be directly or indirectly connected to said toe clamp means. In accordance with the measures of the invention a quasi-rigid connection is achieved in the direction of the auxiliary force between the force signalling device and the associated spring means or a component on which said spring means acts. This arrangement ensures that, on the one hand, movement of the force transmission device does not occur before the start of a safety release and, on the other hand, that the auxiliary force is maintained during the entire safety release movement. This is of particular significance in connection with modern safety toe units because these are provided with a considerable degree of lateral elasticity so that safety release first occurs after a predetermined resiliently opposed movement of the toe clamp means to either side of the longitudinal centre line of the binding. If this movement is not exceeded on the occurrence of a side force then the toe unit automatically returns to its normal ski boot securing position. The force transmission device between the force signalling device to which the pressure prevailing in the ball region of the ski boot is applied and the component which applies the auxiliary force to the safety release mechanism can be constructed to have a mechanical advantage which can be freely chosen within wide limits. It is, however, essential that this force transmission device is in each case so constructed that the spring means or a part to which it is applied (such as a draw rod, yoke or lever on a toe clamp) is biased by the auxiliary force in the direction in which it would move during safety release, i.e. in the sense of reducing the safety release setting. The pressure prevailing at the ball region of the ski shoe is thus directly or indirectly applied to said spring means in the sense of reducing the force which needs to be exerted to overcome the installed load of said spring means which determines the release setting of the toe unit.

It is a requirement of the invention that the magnitude of the auxiliary force is always smaller than the spring bias which determines the release setting of the binding, for any load exertable by the skier through the ball region of the ski boot on the force signalling device. This ensures that a large pressure at the ball region of the ski boot cannot of itself produce untimely side release of the binding.

This feature is of course also important in ensuring that relative movement between the components of the force transmitting device does not take place until sideways release is initiated; in other words wear of the components can only possibly occur during sideways release and not during normal skiing.

It is particularly advantageous if the auxiliary force lies within the range from 0 to 40% of the installed spring bias. In other words the auxiliary force generated by pressure from the ball region of the ski boot on the force signalling device should at most be capable of compensating for 40%, or at the very outside 50%, of the installed spring load.

In accordance with a preferred embodiment of the invention the auxiliary force is directly or indirectly applied to the or to each part of the toe clamp in the direction of movement that takes place on safety release.

An especially preferred embodiment is characterized in that the auxiliary force is proportional, and preferably directly proportional, to the force applied to the force signalling device. In this manner account is taken of the fact that the frictional resistance of the ski boot against sideways movement rises in substantially direct proportion to the pressure prevailing at the ball region of the ski boot. Thus compensation is automatically provided for the prevailing level of frictional resistance.

A substantially uniform loading of the leg of the skier during side release is achieved independently of the pressure prevailing at the ball region of the ski boot during release if, in accordance with a further preferred embodiment, the mechanical advantage between the force applied to the force signalling device and the auxiliary force has a value such that the auxiliary force reduces the installed spring bias by an amount corresponding to the frictional force which opposes the sideways movement of the ski boot. The safety toe unit should as far as possible be matched to this requirement.

In the simplest case the force transmitting device is realized in the form of a mechanical transmission. For this purpose a force signalling device, e.g. in the form of a plate directly located at a position corresponding to the ball region of the ski boot, can operate on an actuating rod extending towards the toe clamp means by way of a wedge drive or a lever mechanism, which transmits the force exerted thereon from the plate to the toe clamp means. A gear mechanism or a lever mechanism can be interposed between the actuating rod and the toe clamp means.

A further possibility for the practical realization of the thought underlying the present invention is to use a hydraulic system for the force transmission device. For this purpose either a hydraulic piston-in-cylinder assembly or a hydraulic cushion can be arranged beneath the plate located at a position corresponding to the ball region of the ski boot and the pressure chamber of the device can be connected, via a fluid duct, to a hydraulic piston-in-cylinder assembly or to a hydraulic cushion which applies the auxiliary force to the toe clamp means.

All the mechanical elements which take part in transmitting movement from the toe clamp or from a part of the toe clamp to the end, or ends, of the, or each, bias spring can basically be used to apply the auxiliary force in the desired manner. These mechanical parts include the, or each, end of the, or each, bias spring and the toe clamp or at least a part of the toe clamp.

E.g. the auxiliary force can be applied to a yoke on which the release spring acts and which cooperates with a pair of toe clamp parts respectively pivotable to either side of the binding.

In a further embodiment the auxiliary force is applied via a force dividing unit and lever arms to two sideways pivotable toe clamp parts which are drawn towards one another into the normal ski boot securing position by means of a spring connected therebetween.

A further advantageous embodiment is characterized in that the auxiliary force is applied to two sideways pivotable toe clamp parts via a yoke and the two, left- and right-hand, toe clamp parts are each individually biased towards the normal ski boot securing position via a respective spring. Alternatively the auxiliary force can also be applied to a draw rod which transmits the force of the release spring to a single toe clamp which is pivotable to either side of the toe unit. The toe clamp is pivotally connected to the draw rod and abuts the binding housing at two locations on either side of the central longitudinal axis thereof, which locations defined respective side disposed pivot axes. The draw rod is particularly suitable for the transmission of the auxiliary relieving force.

In addition the invention can also be used without difficulty with single pivot toe units by arranging for the auxiliary force to be applied to a lever arranged within a single piece toe clamp and located between the release spring and a flattened portion of a vertically upstanding journal which forms the pivot axis for the toe clamp.

Figure 2:
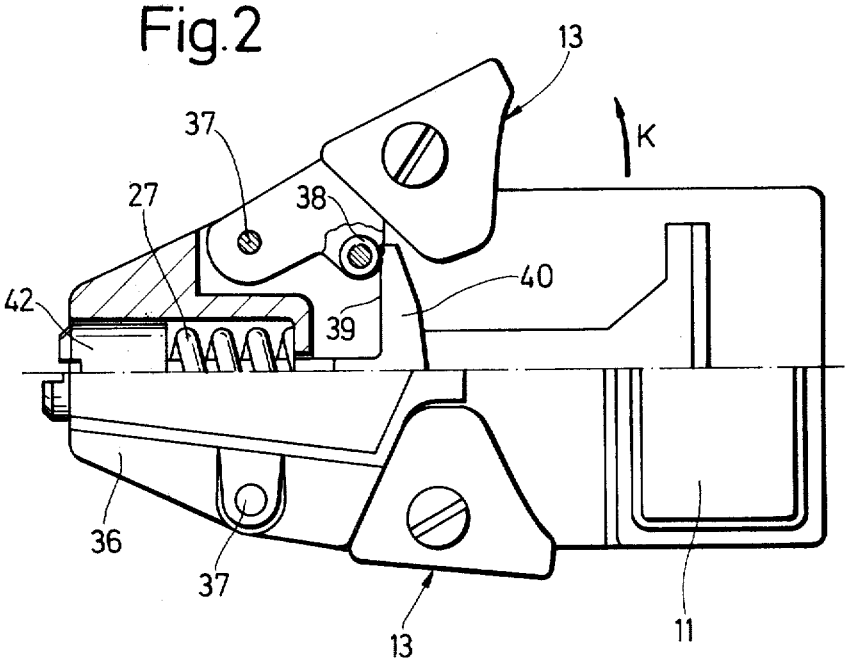
Figure 3:
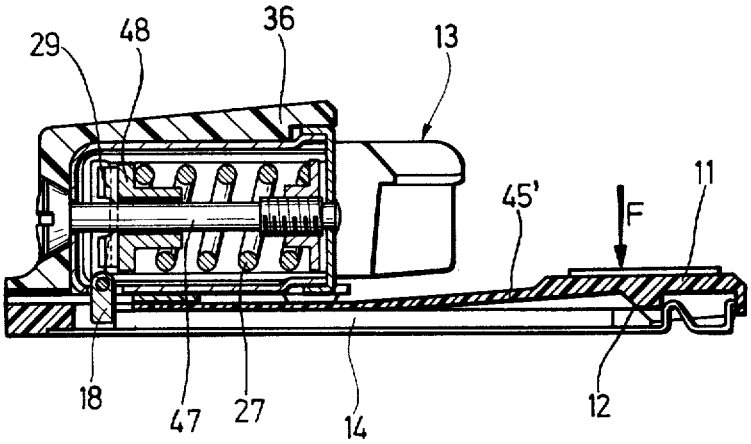
Figure 4:
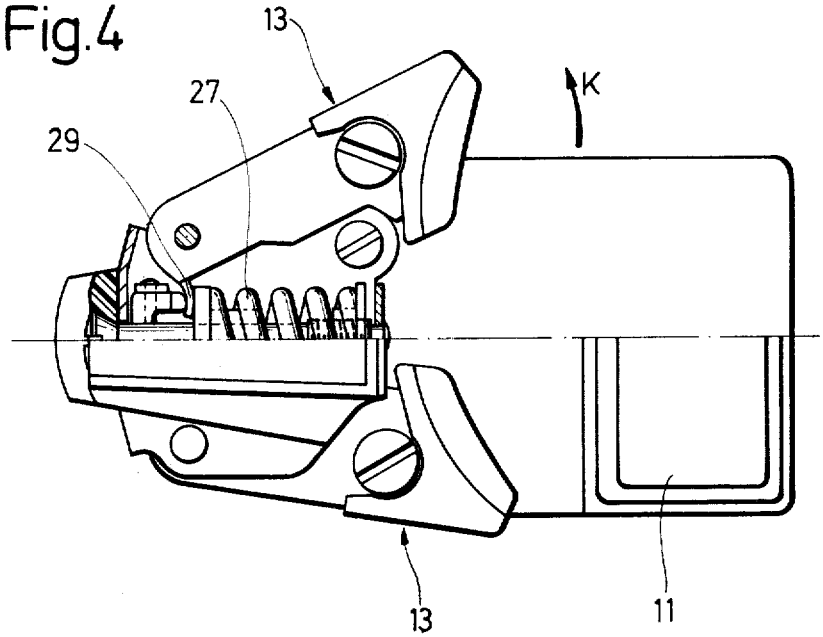
Figure 5:
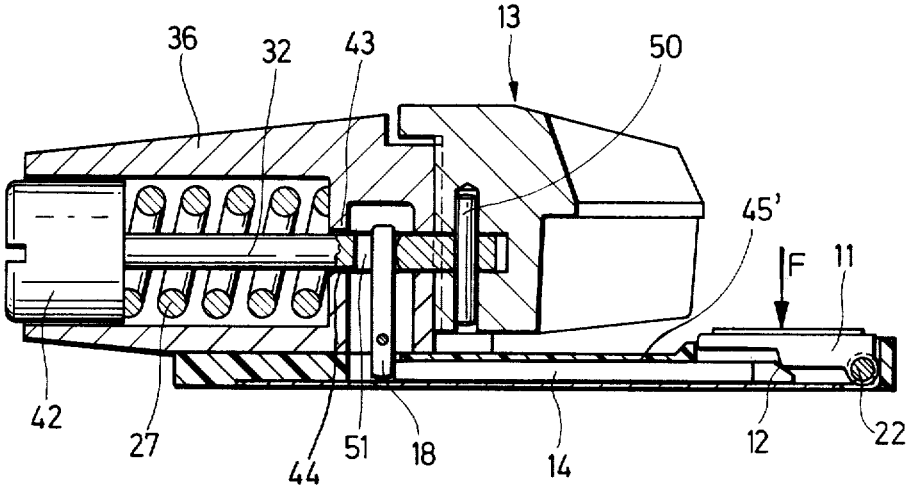
Figure 6:
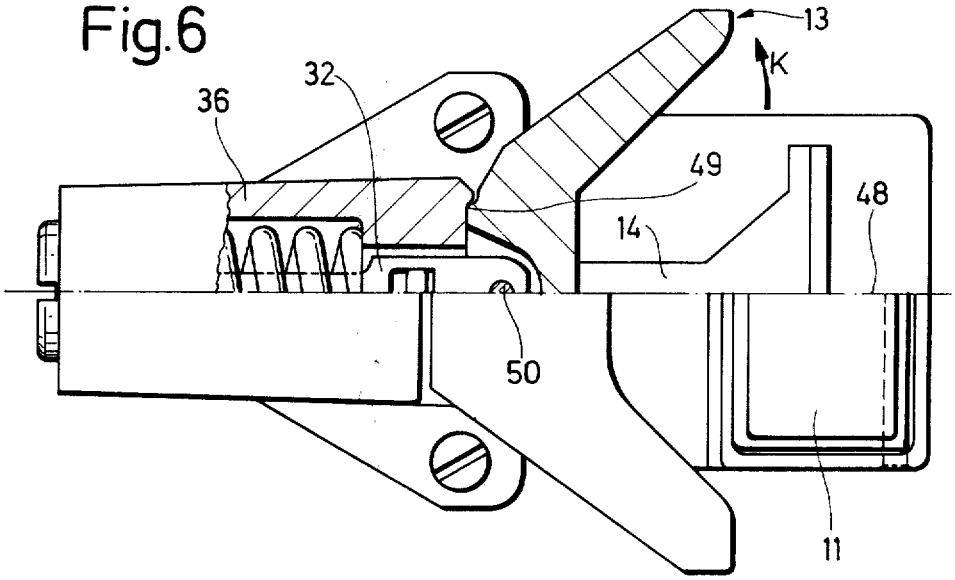
Figure 7:
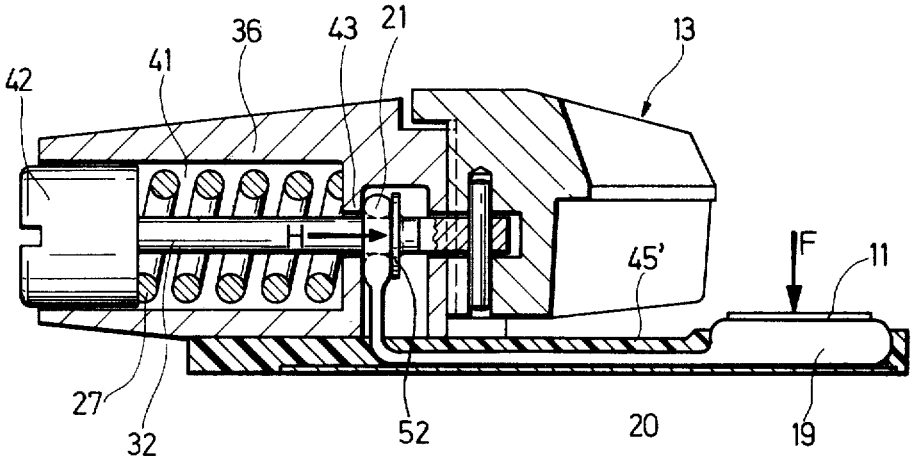
Figure 8:
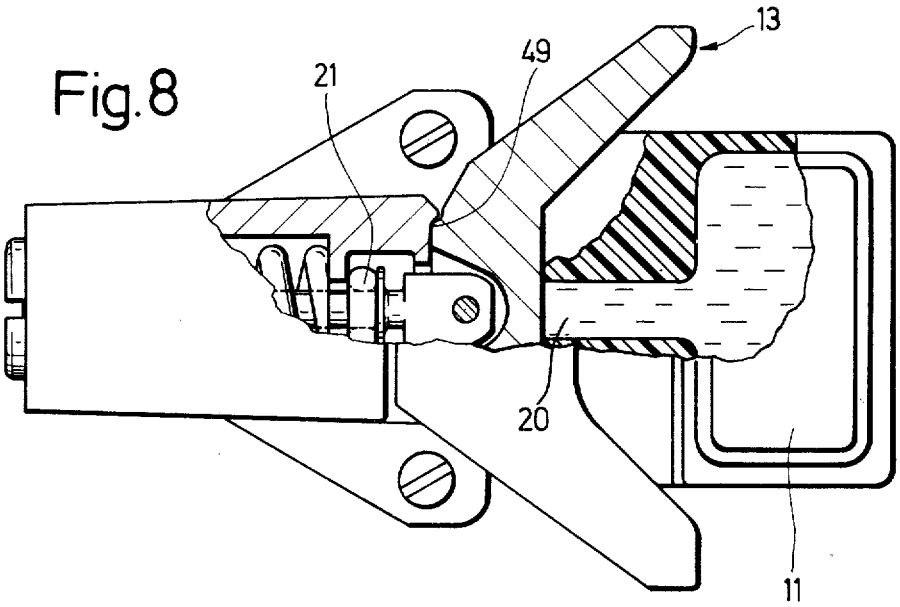
Figure 9:
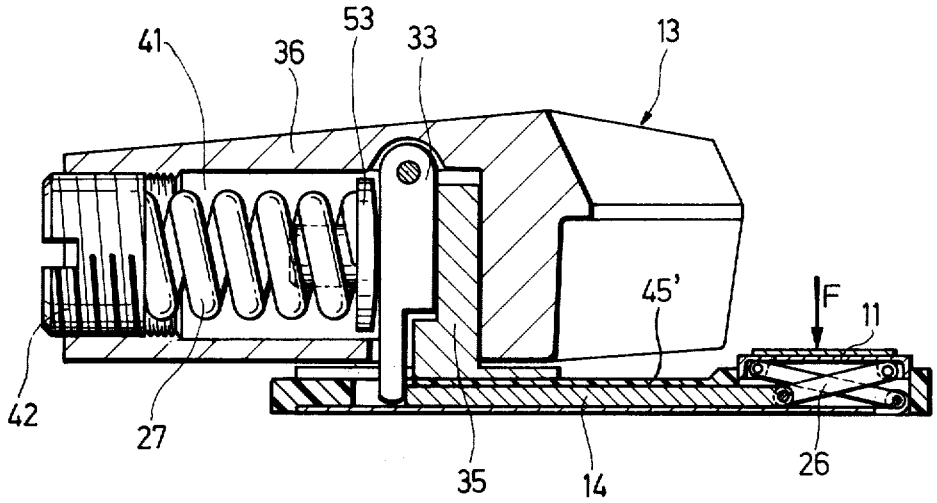
Figure 10:
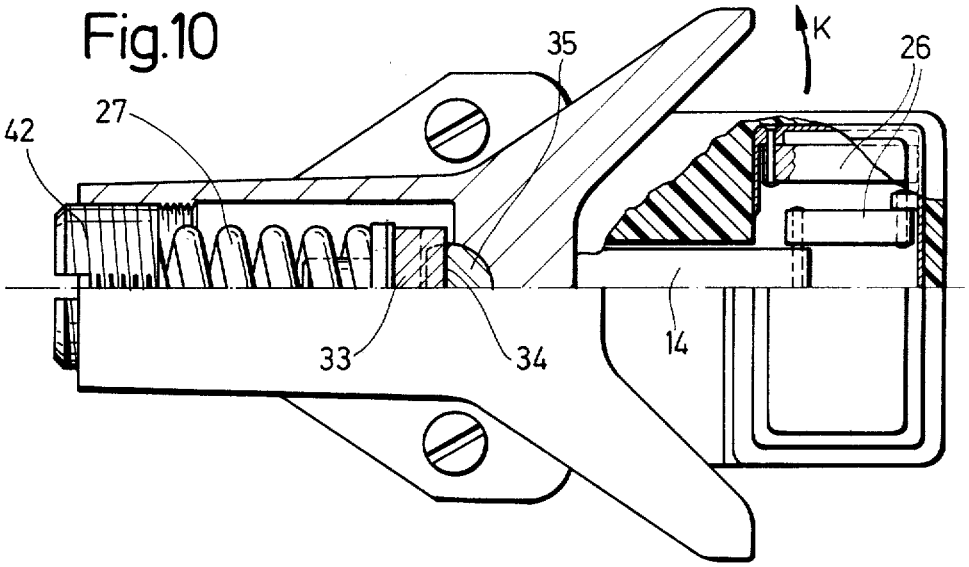
Figure 14:
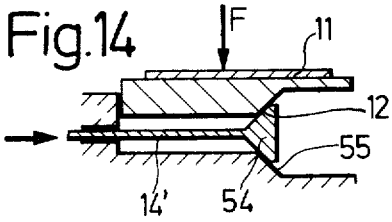
Figure 15:
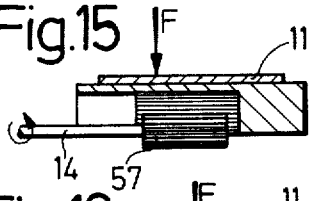
Figure 16:
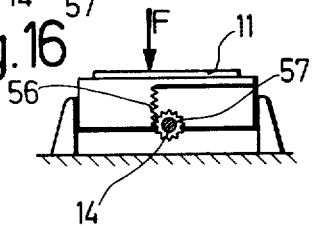

The invention will now be described in the following by way of example only and with reference to the accompanying drawings in which are shown:

FIG. 1 a partially sectioned side view of a first embodiment of a safety toe unit incorporating a mechanical force transmission device, FIG. 2 a partially sectioned plan view of the subject of FIG. 1 showing the toe clamp in the released condition, FIG. 3 a partially sectioned side view of a further embodiment of a safety toe unit incorporating a mechanical force transmission device, FIG. 4 a partially sectioned plan view of the subject of FIG. 3 with one of the two sideways pivotable toe clamps illustrated in the safety release position, FIG. 5 a partially sectioned side view of a third embodiment incorporating a mechanical force transmission device, FIG. 6 a partially sectioned plan view of the subject of FIG. 5, FIG. 7 a partially sectioned side view of a fourth embodiment of a safety toe unit but incorporating a hydraulic force transmission device, FIG. 8 a partially sectioned plan view of the subject of FIG. 7, FIG. 9 a partially sectioned side view of a fifth embodiment of a safety toe unit incorporating a mechanical force transmission device, FIG. 10 a partially sectioned plan view of the subject of FIG. 9, FIGS. 11 to 15 partly sectioned schematic side views of various force signalling and force transmitting devices which are suitable for use with safety toe units in accordance with the present teaching, FIG. 16 a cross-section of the subject of FIG. 15 and FIGS. 17 to 20 schematic partial plan views of various embodiments of safety toe units illustrating various possibilities for applying the auxiliary force to these toe units in accordance with the present teaching.

Turning firstly to FIGS. 1 and 2 there can be seen a safety toe unit having a housing 36 with first and second, left and right-hand, toe clamp parts 13 which are journalled about respective vertical axes 37 and are independently pivotable about these axes to respective sides of the toe unit. Friction reducing guide rollers 38 are mounted on each of the toe clamp parts 13 and engage a profiled cam surface 39 on a yoke 40. The yoke 40 is connected with a draw rod 32 which extends axially in the spring receiving space 41 of a housing 36. An adjustable spring abutment nut 42 is connected by screw threads to the forward end of the draw rod 32 and a single release spring in the form of a compression coil spring extends between the adjustable abutment 42 and an intermediate wall 43 of the housing 36. The draw rod 32 passes through an opening 44 in the intermediate wall 43. The compressed release spring 27 holds the individual sole clamp parts 13 via the draw rod 32, the yoke 40, the profile cam track 39 and the rollers 38 in their respective normal closed positions as illustrated by the lower half of FIG. 2. In this position of two left and right, first and second, toe clamp parts together form toe clamp means for securing the toe portion of the sole of the ski boot to a ski. On the occurrence of a sideways force at the toe portion of the ski boot which exceeds the release setting of the spring 27 the toe clamp part to which the force is applied swings outwardly about its respective axis 37 to release the ski boot. During this sideways outward movement of the toe clamp part 13 the spring 27 is compressed by movement of the yoke 40 and this movement is transmitted to the forward end of the spring 27 via the draw rod 32 and the adjustable spring abutment 42.

A plate 11 is located behind the safety toe unit at a position which corresponds to the position adopted in use by the ball region of a ski boot. The plate 11 is supported so that it can move by a small amount in the vertical direction. An inclined surface 45 is provided on the lower side of the plate 11 which cooperates with a corresponding countersurface 46 formed on an actuating rod 14 to define a wedge drive 12. The actuating rod 14 extends substantially in the longitudinal direction of the ski beneath a cover plate 45' to the region beneath the draw rod 32. At this location the actuating rod 14 is no longer covered by the cover plate 45 and has an upwardly directed toothed region 16 which meshes with toothed wheel 15 rotatably supported about a transverse axis in the housing 36. Above the toothed wheel the underside of the draw rod 32 is likewise provided with a toothed bar region 17 which meshes with the toothed wheel 15 from above.

If the ball region of the ski boot presses e.g. with a force F on the top of the plate 11, then this plate 11 acts as a force signalling device and the force is transmitted via the force transmission device formed by the wedge drive 12 from a force exerted perpendicular to the plate 11 to a force directed along the actuating rod 14. The rod 14 thus attempts to move in the forward direction. As a result a torque is exerted via the toothed bar region 16 on the toothed wheel 15 which in turn transmits an auxiliary force H to the draw rod 32 in the direction of the arrow shown in FIG. 1. This auxiliary force corresponds to a reduction of the spring bias of the release spring 27 and results in a reduction of the release setting, i.e. a reduction of the release force K which is necessary to produce a safety release of the toe unit. Thus as the pressure on the plate 11 increases so does the force F (equal to pressure x area) which is signalled by the force signalling device with the result that the auxiliary force H likewise increases and it becomes progressively easier to produce sideways release opening of the toe unit. The dimensioning of the mechanical transmission formed by the parts 12, 14, 15, 16 and 17 is chosen so that the release force K is directly reduced by an amount equal to the boot friction on the plate 11. In this way the release characteristic as related to the leg of the skier remains constant and independent of the frictional resistance occurring at the ball region of the ski boot.

It is important to note that the mechanical advantage of the force transmitting device is such that, having regard to the maximum load which a skier can exert via the ball region of the ski shoe on the plate 11, the auxiliary force is always less than the force needed to overcome the installed spring bias of the release spring 27. The mechanical advantage, which may well be less than 1 is preferably chosen so that the auxiliary force can have a maximum value of 40%, and at the very most 50%, of the installed spring bias. It will be noted that because of this restriction no relative movement can occur between the components of the force transmitting device until sideways release of the toe unit is initiated. In this way the possibility of wear on these components is minimized. Furthermore, the toe clamp means defined by the two parts of the toe clamp is maintained without slackness in the ski boot retaining position right up to the moment of sideways release. In addition, because a mechanical connection exists between the end of the spring which moves on movement of the toe clamp parts away from the normal closed position, the release spring 27 is able to reset the force transmitting device following safety release of the toe unit.

Further embodiments of the invention will now be described with reference to the further drawings and in these embodiments like reference numerals have been used to describe parts which correspond with equivalent parts of the embodiment of FIGS. 1 and 2.

Turning now to the embodiment shown in FIGS. 3 and 4 there can be seen a safety toe unit similar to that of FIGS. 1 and 2 but in which the adjustable spring abutment is located at the rear end of the binding housing adjacent the ski boot. The release spring 27 bears at its forward, movable end on a further spring abutment 48 which is axially displaceably supported on a bar 47 which extends coaxially from the front end of the housing through the spring to the adjustable rear spring abutment. Under the influence of the release spring 27 the slidable front abutment 48 exerts a closing moment on the first and second, left- and right-hand, toe clamp parts 13 via lever arms 29 formed on these toe clamp parts. The toe clamp parts are thus urged to the normally closed ski boot securing position illustrated in the lower half of FIG. 4.

As can be seen from FIG. 3 a fork-like lever 18 which is pivotally mounted about a transverse axis in the housing 36 bears on the axially movable spring abutment 48 through the intermediary of the lever arms 29. The end of the lever 18 which projects beneath the transverse axis in engaged by the acutating rod 14 which is once more actuated from the plate 11 via the wedge drive 12. The lever 18 experiences a torque in the clockwise direction as a result of the force F on the plate 11 so that the lever arm 29 is partly relieved of the force of the release spring 27 and sideways release is made correspondingly easier. The dimensions and mechanical advantage of the transmission are arranged in the same way as in the preceding embodiment.

The upper half of FIG. 4 illustrates the right-hand toe clamp part 13 in the deployed position for sideways release of the ski boot. The cover 45' is resilient and is connected to the plate 11.

In the embodiment of FIGS. 5 and 6 a one-piece toe clamp 13 is urged by a draw rod 32 towards the housing 36 to produce contact between complementary pairs of abutment surfaces 49 disposed one pair to either side of the central longitudinal axis 48 between the toe clamp 13 and the housing 36. The draw rod 32 which is pivotally connected to the toe clamp 13 is drawn, i.e. is subjected to tensile loads by a release spring 27 located within the housing 36. The application of tensile load to the draw rod 32 by the release spring 27 takes place in the same manner as for the embodiment of FIGS. 1 and 2.

The two complementary pairs of abutment surfaces 49 define respective left- and right-hand pivot axes and the one-piece sole clamp 13 can pivot about either of these axes to the left or to the right to a position in which the ski boot is released from the binding.

The pressure at the ball region of the ski boot is once more applied to a plate 11 but in this case the plate 11 is pivotally mounted on the base plate of the binding about a transverse pivot axis 22. A wedge drive 12 once more loads an actuating rod 14 in response to pressure applied to the plate 11. The forward end of the actuating rod 14 is connected to an arm of a double-armed lever 18 which is pivotally mounted about a transverse axis in the housing 36. The upper arm of the lever 18 extends through a vertically directed spring 51 in the draw rod 32. The arrangement is such that as soon as the force F is applied to the plate 11 the auxiliary force H is exerted on the rear wall surrounding the opening 51 in the direction towards the ski boot. As a result, as in the previous embodiments, the draw rod 32 which pulls on the toe clamp 13 is relieved by an amount which is proportional to the force F exerted by the ski boot on the plate 11.

The embodiment of FIGS. 7 and 8 corresponds substantially with that of FIGS. 5 and 6 but with the exception that a hydraulic force transmission device is provided between the plate 11 and the draw rod 32 in place of a mechanical transmission. Beneath the plate 11 there is located a hydraulic cushion which contains an incompressible liquid which is in connection with a torus-shaped hydraulic cushion 21 via a conduit 20. As can be seen from FIGS. 7 and 8 the toroidal hydraulic cushion passes around the draw rod 32. The toroidal cushion 21 is braced on the one hand against the intermediate wall 43 of the housing 36 and on the other hand against the collar 52 of the draw rod 32. If the hydraulic cushion 21 is pressurized as a result of a force F being exerted on the pressure plate 11 then it exerts the required auxiliary force H on the draw rod 32 via the collar 52.

FIGS. 9 and 10 show a one-piece toe clamp 13 pivotally journalled on the ski about an upstanding pivot bolt 35. The toe clamp 13 includes a space 41 for accommodating the release spring 27. In this embodiment the toe clamp 13 and the space 41 both form part of a common housing 36. The release spring 27 bears at one of its ends on an adjustment screw 42 which is screw-threaded into a threaded bore of the housing 36. At its other end the release spring 27 presses a spring abutment 53 against a lever 33 and presses this lever against a flat 34 provided on the front side of the pivot pin 35. The lever 33 is pivotally connected at its top end about a transverse pivot axis in the housing 36. During sideways release of the binding the unit comprising the housing and the toe clamp 13 can pivot to one or other side about the pivot pin 35 whereupon the lever 33 is pressed forwardly whilst compressing the spring 27 and exerts a resetting moment on the toe clamp.

The lever 33 has an extension projecting beneath the housing 36 which cooperates with the actuating rod 14. The actuating rod 14 is once more loaded in response to the force F applied to the plate 11. In this embodiment, however, the conversion of the perpendicular force F to a force directed along the actuating rod 14 is not effected using a wedge drive but rather by using a lever mechanism of the scissors' type. It would of course be equally possible to use a wedge drive with this embodiment. In FIGS. 11 to 16 there are shown various possibilities for converting the perpendicular force F into a force directed along an actuating rod at right angles to the direction of the force F.

Figure 11:
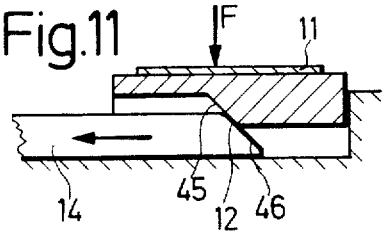

FIG. 11 shows in enlarged form the wedge drive 12 as is e.g. shown in connection with the safety toe unit of FIGS. 1 and 2.

Figure 12:
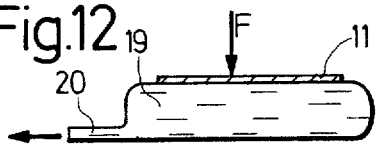

FIG. 12 shows in enlarged form the hydraulic cushion 19 as used in the embodiments of FIGS. 7 and 8 and to which pressure is applied via the plate 11. The connection conduit 20 is also illustrated.

Figure 13:
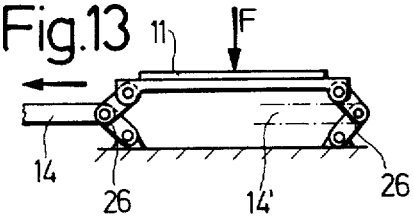

FIG. 13 shows a lever mechanism 26 for converting the force generated at the ball region of the ski boot into a horizontally directed force on the actuating rod 14. The construction of this lever mechanism is similar to that of FIGS. 9 and 10. The arrangement of FIG. 13 shows two alternative arrangements for the actuating rod 14. In the first the actuating rod is connected to the knee joint of the left-hand pair of pivoted levers 26 and generates a forwardly directed compressive force in the actuating rod 14. In the arrangement to the right-hand side of FIG. 13 the actuating rod 14' is connected to the right-hand knee joint which enables the actuating rod 14' to be pulled rearwardly, i.e. subjected to tension. In this way it is also possible to apply a tensile force to the safety toe unit.

FIG. 14 shows a further embodiment which enables a tensile force to be generated in the actuation rod 14 by the exertion of the force F on the plate 11. The FIG. 14 arrangement once more employs a wedge drive, however, a wedge drive which operates in the opposite direction to the wedge drive of FIG. 11. In the FIG. 14 arrangement a wedge element 54 is provided at the end of the actuating rod 14' and the two wedge surfaces of the wedge element 54 respectively cooperate with the inclined surface 45 on the lower side of the plate 11 and the inclined surface 55 which is fixed relative to the ski and which is inclined to the inclined surface 45 at an angle corresponding to the wedge angle of the wedge element 54. As in this embodiment, as the element 14' is loaded in tension, it can also take the form of a cable or a chain (because it is only necessary for it to transmit tensile forces).

FIGS. 15 and 16 illustrate an alternative possibility for converting the perpendicular force F on the plate 11 into a torque on the actuating rod 14. This can e.g. be achieved by providing a linear toothed gear 56 on the edge of a cut-out on the lower side of the plate 11 which cooperates with a toothed wheel 57 at the end of the actuating rod 14. On depressing the plate 11 a torque is exerted on the actuating rod 14 in the sense shown by the arrow of FIG. 15. This torque can then be converted in suitable manner at the safety toe unit into a relieving force for the release spring.

FIGS. 17 to 20 show various further possibilities for utilizing the invention with known binding types.

Figure 17:
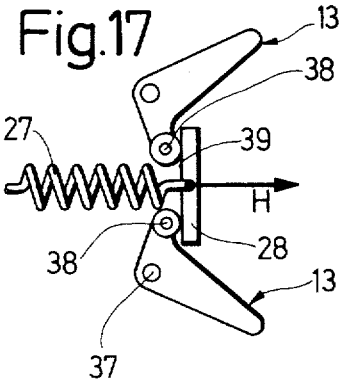

In FIG. 17 there is illustrated a safety toe unit in which right- and left-hand toe clamp parts are respectively pivotable to the left and to the right about respective vertical axes 37. Friction reducing rollers 38 are applied to a profiled cam track 39 on a yoke 28 which is drawn forwardly, i.e. to the left in FIG. 17 by a tension-type coil spring 27. The only basic difference between this construction and the binding shown in FIGS. 1 and 2 is that the compression spring has now been replaced by a tension spring. In accordance with the present teaching the auxiliary force H is applied at the centre of the yoke 28 and is once more applied so that it exerts a force at that end of the spring which moves during sideways release of the binding. For generating the tensile force H one can e.g. use the type of device shown in FIG. 14.

Figure 18:
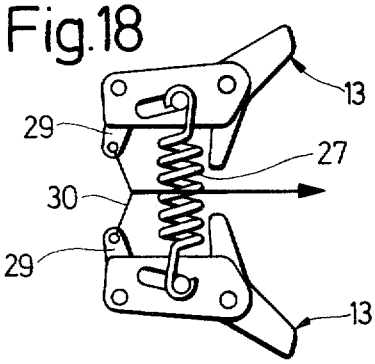

The type of device shown in FIG. 14 can also be used with a binding of the type shown in FIG. 18. In FIG. 18 right- and left-hand toe clamp parts 13 are drawn together by a release spring 27 which is arranged transversely to the longitudinal centre line of the binding.

The auxiliary force H can be divided via a force branching device 30 so that corresponding forces are applied to the two lever arms 29 which are respectively connected in the illustrated manner one to each of the left- and right-hand toe clamp parts 13. The auxiliary force H is thus applied to both left- and right-hand toe clamp parts 13 in the sense of applying an opening torque thereon. As mentioned above the arrangement is, however, such that the force H is not of sufficient magnitude that it can overcome the tension in the spring and produce opening of the binding of its own accord. The auxiliary force should at most equate with one half of the force which is required to open the binding.

Figure 19:
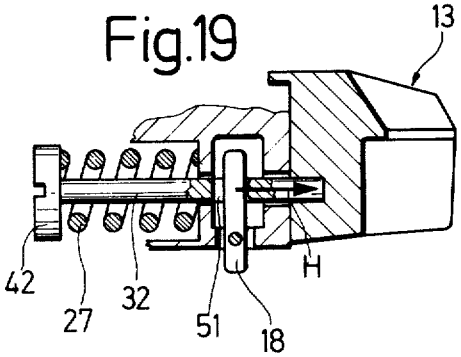

FIG. 19 once more reproduces parts of the binding of FIG. 5 but in a form which facilitates understanding thereof. The force transmission devices of FIGS. 11 and 13 are, amongst others, suitable for applying the auxiliary force H to the arrangement of FIG. 19.

Figure 20:
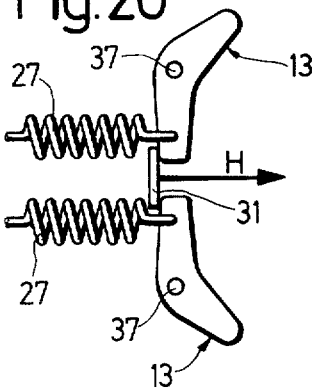

Finally FIG. 20 shows a binding of the type incorporating left- and right-hand toe clamp parts 13 which are biased towards the normal closed ski boot securing position by respective first and second release springs 27. The release springs 27 are tension-type springs. The auxiliary force H can be divided by a specially provided yoke 31 disposed between both toe clamp parts 13 in such a way that one half of the total relief force is applied to each toe clamp part. The force transmission device of FIG. 14 is once more suitable for providing the auxiliary force H.

It is essential in all embodiments that purely static conditions prevail at the beginning of a release movement, i.e. that apart from the unavoidable elastic deformations of the individual components none of the elements of the safety toe unit move under the influence of the prevailing forces until safety release occurs. This signifies that work is only supplied to the system when a release movement is initiated. Furthermore, the effects of wear on the parts which move during a release do not occur during use of the binding, i.e. unless a release process is begun or completed. It is furthermore important that the room for movement of the force transmitting device extending between the plate to the point at which the auxiliary force is applied to the toe clamp, to the draw rod, to the end of the spring or the like is sufficiently large that the auxiliary force H which aids the release is effective at least until the release movement of the toe clamp 13 is so far advanced that either the ski boot is already released or the lay-out of the system means that the release force collapses at some earlier stage of the release process.

We claim:

1. A safety toe unit for a ski binding having a safety release mechanism comprising toe clamp means for releasably securing the toe of a ski boot to a ski, spring means having first and second ends and being maintained in biased condition to be operative to bias said toe clamp means into a ski boot securing position and operative, on the occurrence of a predetermined sideways load on said toe clamp means to permit sideways pivoting movement of at least a part of said toe clamp means to a ski boot releasing position, means for transmitting a force from said toe clamp means to said first end during said sideways pivoting movement to produce corresponding movement of said first end and abutment means for reacting said force at said second end of said spring means, a force signalling device adapted to be arranged at a position corresponding to the position adopted in operation by the ball region of the sole of the ski boot, said force signalling device being responsive to pressure exerted from above to generate, via a force transmission device, an auxiliary force active on said first end in the direction of the first said force whereby to reduce the bias of said spring means on said toe clamp means to assist the release thereof, and wherein the mechanical advantage produced by said force signalling device and said transmitting device is such that the magnitude of said auxiliary force is always smaller than the spring bias which determines the release setting of the binding for any load exertable by a skier through the ball region of the ski boot on said force signalling device.

2. A safety toe unit in accordance with claim 1 in which over the maximum range of variation of pressure exerted by the ball region on said force signalling device, said auxiliary force lies within the range from 0 to 40% of the installed spring bias.

3. A safety toe unit in accordance with claim 1 and in which said means for applying the auxiliary force to said first end acts directly on said first end.

4. A safety toe unit in accordance with claim 1 and in which said means for applying the auxiliary force to said first end acts indirectly on said first end.

5. A safety toe unit in accordance with claim 1 and in which said auxiliary force is directly applied to said toe clamp means in the direction of release movement thereof.

6. A safety toe unit in accordance with claim 1 and in which said auxiliary force is indirectly applied to said toe clamp means in the direction of release movement thereof.

7. A safety toe unit in accordance with claim 1 and in which said auxiliary force is proportional to the pressure exerted on said force signalling device.

8. A safety toe unit in accordance with claim 7 and in which said auxiliary force is directly proportional to the pressure exerted on said force signalling device.

9. A safety toe unit in accordance with claim 1 and in which said mechanical advantage has a value such that said auxiliary force reduces said spring bias by an amount substantially equal to the frictional force which opposes the sideways movement of said ski boot.

10. A safety toe unit in accordance with claim 1 and in which said force transmission device comprises a mechanical transmission device.

11. A safety toe unit in accordance with claim 10 and in which said force signalling device comprises a plate and said force transmitting device includes means for converting a force directed substantially perpendicular to said plate to a force substantially at right angles thereto in an actuating device extending from said plate to said toe clamp means.

12. A safety toe unit in accordance with claim 11 and in which said means for converting a force substantially perpendicular to said plate to a force substantially at right angles thereto comprises a wedge drive.

13. A safety toe unit in accordance with claim 11 and in which said means for converting a force substantially perpendicular to said plate to a force substantially at right angles thereto comprises a lever mechanism.

14. A safety toe unit in accordance with claim 11 and in which a toothed gear drive is inserted between said actuating device and said toe clamp means.

15. A safety toe unit in accordance with claim 14 and in which an intermediate member is inserted between said toothed gear drive and said toe clamp means.

16. A safety toe unit in accordance with claim 11 and in which a lever mechanism is inserted between said toe clamp means and said actuating device.

17. A safety toe unit in accordance with claim 16 and in which an intermediate member is inserted between said toe clamp means and said lever mechanism.

18. A safety toe unit in accordance with claim 1 and in which said force transmission device comprises a hydraulic system.

19. A safety toe unit in accordance with claim 18 and in which said force signalling means comprises a plate and means for converting the pressure exerted on said plate to a related hydraulic pressure and wherein said hydraulic system comprises a conduit extending from said means beneath said plate to a hydraulic actuating device operative to exert a force on said toe clamp means.

20. A safety toe unit in accordance with claim 19 and in which said means beneath said plate comprises a piston-in-cylinder assembly.

21. A safety toe unit in accordance with claim 19 and in which said means beneath said plate comprises a hydraulic cushion.

22. A safety toe unit in accordance with claim 19 and in which said hydraulic actuator comprises a piston-in-cylinder assembly.

23. A safety toe unit in accordance with claim 19 and in which said hydraulic actuator comprises a hydraulic cushion.

24. A safety toe unit in accordance with claim 23 and in which said cushion comprises a toroidal cushion interposed between fixed structure and structure associated with said toe clamp means.

25. A safety toe unit in accordance with claim 1 and in which said auxiliary force is applied to a yoke member, said yoke member being associated with said first end of said spring means for movement together therewith and cooperates with first and second sideways pivotable toe clamp parts forming said toe clamp means.

26. A safety unit in accordance with claim 1 and in which said toe clamp means comprises first and second sideways pivotable toe clamp parts and said spring means comprises a spring disposed to draw said first and second toe clamp parts towards one another and in which said auxiliary force is applied to said first and second toe clamp parts via a force dividing means and respective lever arms.

27. A safety toe unit in accordance with claim 1 and in which said auxiliary force is applied via a yoke to first and second sideways pivotable toe clamp parts defining said toe clamp means and wherein said spring means comprises first and second springs respectively associated with said first and second toe clamp parts for biasing the same to respective ski boot securing positions.

28. A safety toe unit in accordance with claim 1 and in which said toe clamp means comprises a single toe clamp pivotable to either side of said safety toe unit, and wherein said first end of said spring means is connected to said toe clamp via a draw rod and said auxiliary force is applied to said draw rod.

29. A safety toe unit in accordance with claim 1 and in which said auxiliary force is applied to a lever arranged within a single toe clamp defining said toe clamp means between said first end and a flat on a vertically disposed journal, said vertically disposed journal defining the pivot axis for said single toe clamp.

* * * * *